United States Patent [19]

Salesses et al.

[11] Patent Number: 4,809,310

[45] Date of Patent: Feb. 28, 1989

[54] DEVICE FOR SUPPLYING CURRENT TO A FILAMENT OF AN X-RAY TUBE

[75] Inventors: Jacques Salesses, Paris; Arthur Baghdiguian, Boulogne Billancourt, both of France

[73] Assignee: Thomson-CGR, Paris, France

[21] Appl. No.: 35,867

[22] Filed: Apr. 8, 1987

[30] Foreign Application Priority Data

Apr. 11, 1986 [FR] France ..... 86 05240

[51] Int. Cl.[4] ..... H05G 1/34; H05G 1/50

[52] U.S. Cl. ..... 378/109; 378/110; 363/17; 363/98

[58] Field of Search ..... 378/92, 101, 105, 109, 378/110; 363/17, 98

[56] References Cited

U.S. PATENT DOCUMENTS 3,567,995 3/1971 Lauritzen et al. ..... 315/311
3,916,251 10/1975 Hernandez et al. ..... 378/110
4,573,184 2/1986 Tanaka et al. ..... 398/110

FOREIGN PATENT DOCUMENTS 0075283 3/1983 European Pat. Off. .
0137401 4/1985 European Pat. Off. .
2826455 6/1978 Fed. Rep. of Germany .
2471118 6/1981 France .
2005878 4/1979 United Kingdom .
8200397 2/1982 World Int. Prop. O. .

*Primary Examiner*—Eugene R. LaRoche
*Assistant Examiner*—David Mis
*Attorney, Agent, or Firm*—Oblon, Fisher, Spivak, McClelland & Maier

[57] ABSTRACT

The invention pertains to a current-supplying device used to supply heating current to a filment of an X-ray tube. The current-supplying device comprises a current inverter delivering current to a load circuit in which there is an oscillating circuit, the impedance of which is made to vary.

9 Claims, 2 Drawing Sheets

DEVICE FOR SUPPLYING CURRENT TO A FILAMENT OF AN X-RAY TUBE

BACKGROUND OF THE INVENTION

1. Field of the Invention

The invention pertains to a device for supplying power to a filament, especially that of an X-ray tube such as is used in X-ray diagnosis equipment. The invention is especially applicable to cases where a wide range of current values has to be supplied successively to filaments with very different resistance values.

2. Discussion of Background

An X-ray tube for medical diagnosis is generally set up like a diode, i.e. with two electrodes, one of which, called a cathode, emits electrons while the other is called an anode and receives these electrons on a small area which is the source of X-radiation.

The cathode comprises a heated filament which constitutes the source of electrons. When the high voltage supplied by a generator is applied to the terminals of both electrodes, so that the cathode is at negative potential, a so-called anode current is established in the circuit, through the generator, and crosses the space between the cathode and the anode in the form of a beam of electrons, the intensity of which depends on the temperature of the filament, this temperature depending on the power dissipated in the filament i.e. on the current, called the heating current, which flows in the filament.

The quantity of X-rays emitted by the anode depends chiefly on the intensity of the anode current and, hence, on the intensity of the filament-heating current.

Thus, the filament-heating current is one of the major parameters which must be determined for each radiographic or radioscopic exposure during an X-ray examination of a patient.

The parameters of the exposure are determined according to the nature of the examination. These parameters are generally pre-determined by an operator who sets their values on a control panel which controls the functioning of the various elements of an X-ray diagnosis installation such as, for example, the high-voltage generator and the generator of filament-heating current. Usually, in certain installations, the values of these parameters are pre-determined by means of a microprocessor-based device which may or may not be built into the control panel and which calculates and programs the optimum values of these parameters according to, for example, the type of examination desired by the practitioner and according to the specific characteristics of the installation.

In all cases, this operation particularly involves programming different values such as, for example, the length of the exposure time, the energy of the X-radiation by choosing the value of the high voltage applied between the anode and the cathode, and the intensity of the anode current by choosing, in particular, a value of the filament-heating current intensity.

It must be noted that the intensity of the heating current can be substantially altered from one exposure to the following one, for example, from 1.5 amperes to 5.5 amperes.

Furthermore, X-ray diagnosis installations usually include several X-ray tubes with different characteristics, which are successively put into operation, sometimes during the same examination. These X-ray tubes may comprise filaments, the ohmic resistance value of which may vary considerably from one tube to another, from 0.6 ohms to 4.5 ohms for example. In such cases, it is especially worthwhile to have a heating-current generator which can be used to quickly, i.e. automatically, obtain a heating current value within the range of values referred to earlier, regardless of the resistance value of the filament supplied with current.

Consequently, the generator which produces the heating current must supply this current in a very extensive range of power. Furthermore, within this range of power, it must ensure quality which is adequate for the regulation of the heating current, and must make it possible, quickly and automatically, to obtain the desired intensity value as defined, for example, by a set value. This set value may vary between successive exposures.

Heating-current generators according to the prior art cannot be used to obtain these conditions satisfactorily, because either they require manual adjustments depending on the intensity of the heating current and the resistance value of the filament or they provide for wide-ranging power to the detriment of the quality of regulation. Furthermore requirements in terms of power range, automation system and quality of regulation may result in the designing of complex generators, i.e. generators that are fragile, hardly reliable or bulky and expensive.

It must also be noted that the regulation of the filament-heating current is further complicated by the fact that the cathode and the filament of the X-ray tube are connected to the high voltage negative potential. Hence, the problems of electrical insulation generally lead to the application of heating energy to the filament by means of an isolating transformer, the primary winding of which represents the charge of the filament. As a result the heating current is produced according to an alternating current, for which the measurement of the root-mean-square value can also present problems.

SUMMARY OF THE INVENTION

The current-supplying device according to the invention does not have the disadvantages mentioned above, owing to a new arrangement which results in an instrument that is easy to build and easy to use.

The present invention pertains to a device for supplying current to a filament of an X-ray tube which can be used to automatically obtain a heating current, the intensity of which corresponds to a set value, this intensity being included within a range of intensity values that can be applied to a filament for all the standard values of the ohmic resistance of the filament.

The invention further pertains to a device for supplying current to a filament of at least one X-ray tube. This device includes a generator which gives control pulses and a current inverter which receives the control pulses and produces, in a load circuit, an alternating heating current from a direct voltage. Also included is a regulator circuit which regulates the heating current according to a set value. The load circuit uses a primary winding of a transformer through which the heating current is applied to the filament with heating current having the same frequency as the frequency of the control pulses. A device having an oscillating circuit is placed in the load circuit, and the regulator circuit delivers an error signal, applied to the generator, to modify the frequency of the control pulses, so as to modify the impedance of the oscillating circuit until a heating current value that corresponds to the set value is obtained.

It is thus possible to achieve flexible and precise control over the power transmitted to the transformer, which links the load circuit to the filament, by causing variations in the impedance of the oscillating circuit through the frequency of the control pulses. This allows for a substantial range of power enabling the device of the invention, successively and automatically, to supply current, in a very broad range of values, to filaments with very different resistance values.

BRIEF DESCRIPTION OF THE DRAWINGS

The invention will be better understood from the following description, given as a non-exhaustive example, and from the two appended figures, of which.

DESCRIPTION OF THE PREFERRED EMBODIMENT

Figure 1:
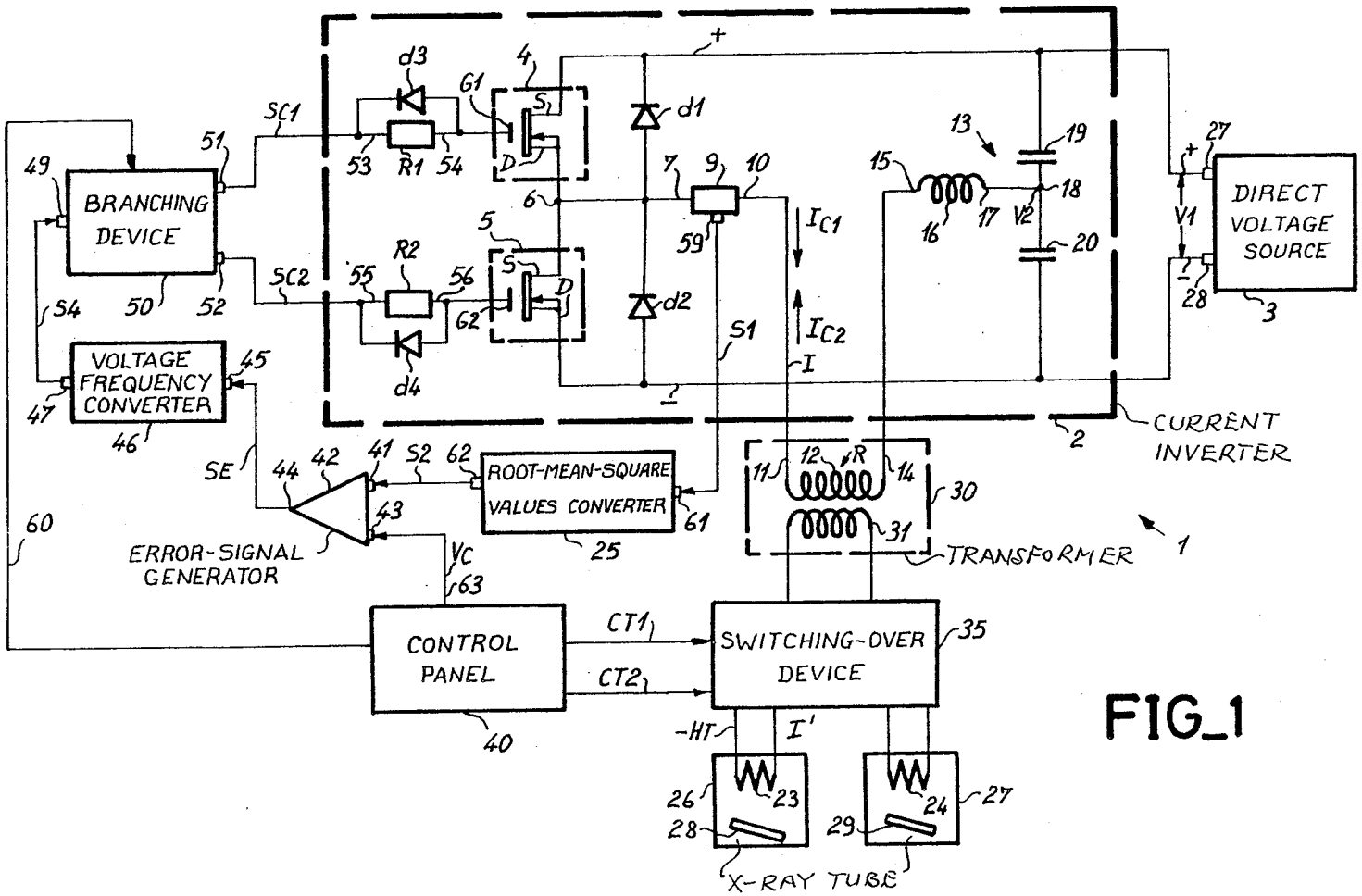
FIG. 1 is a schematic diagram of a current-supplying device according to the invention.

FIG. 1 depicts a current-supplying device 1 according to the invention which can be used, in the non-exhaustive example described, to supply current to the filament of an X-ray tube, selected, for example, from among several X-ray tubes. Only two tubes 26, 27, of which are depicted in the described example.

The X-ray tubes are of a conventional type, each featuring an anode 28, 29 and a cathode 23, 24 represented by the filament that it contains. The tubes 26, 27 are supplied with high voltage by conventional means (not depicted). During operation, the filament 23, 24 of the tube 26, 27 selected is carried to the high voltage negative potential − HV, and the problems of electrical insulation make it necessary to apply, to the filament 23, 24, the electrical energy needed for its heating, by means of an isolating transformer 30.

In the non-exhaustive example described, the first or second tube 26, 27, is selected by connecting the corresponding filament 23, 24 to the secondary winding 31 of the transformer 30, by means of a switching-over device 35, featuring switches (not depicted) that comprise, for example, electromechanical relays. The transformer 30 has a primary winding 12 to which is applied a heating current I delivered by a current inverter 2.

The switching-over device 35 can be controlled either manually or automatically as part of sequences that are programmed and controlled, for example, by a control panel 40, this panel being linked to the switching-over device by a first and second link CT1, CT2, by which it can select the first or second tube 26, 27, the first tube 26 for example, so as to apply a current I' to the filament 23 of this tube, for it to be heated.

It must be noted that a tube 26, 27, can be selected in a different way as, for example, by switching over at the primary coil of the isolating transformer, an isolating transformer being in this case, associated with each filament.

The current-supplying device 1 further comprises a source of regulated direct voltage 3, which delivers, through terminals 27, 28 respectively, the positive polarity + and the negative polarity − of a regulated direct voltage V1, with, for example, a value of 200 volts. The voltage source 3 is made in a conventional way and sets up the direct voltage V1 using, for example, a single-phase A.C. voltage (not depicted) of 220V.

The current inverter 2 is supplied by the direct voltage V1, from which it makes an alternating voltage. The current inverter 2 features two electronic switching-over means 4, 5, arranged in series between the positive pole + and the negative pole − of the direct voltage V1. In the non-exhaustive example described, the two switching-over means 4, 5, comprise field-effect transistors. The source S of the first transistor 4 is linked to the positive pole + of the direct voltage V1 and its drain D is linked to the source S of the second transistor 5, the drain D of which is linked to the negative pole − of the direct voltage V1. A first and a second diode, D1, D2, are respectively mounted in parallel on the first and second transistor 4, 5, the first diode D1 having its cathode linked to the pole + of the voltage V1 and its anode linked, to the junction 6 between the drain of the first transistor 4 and the source of the second transistor 5, and also the anode is linked to the cathode of the second diode 2, the anode of which is linked to the negative pole − of the direct voltage V1.

The junction 6 is further linked to the first end 7 of a current sensor means 9, the second end 10 of which is linked to the first end 11 of the primary winding 12 of the isolating transformer 30. The second end 14 of the primary winding 12 is linked to the first end 15 of an inductor 16, the second end 17 of which is linked to a capacitive mid-point 18. The capacitive mid-point 18 is formed by the junction of a first and a second capacitor 19, 20, series-mounted between the positive and negative terminals, +, −, of the direct voltage V1; the first capacitor 19 being linked to the positive pole + and the second capacitor 20 being linked to the negative pole −.

The two capacitors 19 and 20 form a capacitance linked in series with the inductor 16 to form an oscillating circuit 13 arranged in series with the primary winding 12 of the transformer 30, with which it forms a load circuit 12–13.

In the load circuit 12–13, the primary winding 12 represents the filament 23, the ohmic resistance R of which is carried to the load circuit 12–13. Assuming that the filament 23 is of a conventional type, its resistance R can have any value within the standard range of values, for example, between 0.6 ohms and 4.5 ohms.

Since the current I' in the secondary circuit of the transformer 30, in which the filament 23 is placed, is proportional to the current I flowing in the primary winding circuit or load circuit 12–13 in a known ratio, and since the resistance R of the filament 23 is carried to the load circuit 12–13, it is the current I flowing in the load circuit 12–13 that is called a "heating current" in order to make the description clearer.

The current sensor 9 is placed in the load circuit 12–13 and, through an output 59, delivers a signal S1 which is proportionate to the pseudo-sinusoidal heating current I; the current sensor 9 is of a conventional type such as one comprising, for example, a current transformer.

The signal S1, proportional to the heating current I, is applied to the input 61 of a converting device 25 which processes the values of the signal S1 in a conventional way to give, through an output 62, a second signal S2 corresponding to the root-mean-square value of the heating current I. These root-mean-square values are used to regulate the current I in the primary circuit or load circuit 12–13 which is used, notably by means of the low-leakage isolating transformer 30, to conduct a rigorous check on the current I' that flows into the filament 23, providing for better proportionality between the current I' in the filament 23 and the current I in the load circuit 12–13.

The second signal S2 is applied to the first input 41 of an error signal generator 42 comprising, for example, a differential amplifier. The second input 43 of the error signal generator 42 receives a set value VC corresponding to the desired value of the heating current I. This set value is, for example, delivered by the control panel 40 which, for this purpose, is linked by a link 63 to the second input 43 of the error signal generator 42. The error signal generator 42 delivers, at its output 44, an error signal SE which is proportional to the difference between the second signal S2 and the set value VC. The error signal SE is applied to a means for producing pulses at a given frequency F and for modifying this frequency F upward or downwards depending on the sign and amplitude of the error signal SE. In the non-exhaustive example described, this pulse-producing means comprises a voltage/frequency converter 46, the input 45 of which is linked to the output 44 of the error signal generator 42.

An output 47 of the voltage/frequency converter 46 delivers a fourth signal S4 comprising pulses delivered at the frequency F, which constitutes the initial frequency at which the current inverter 2 functions. The signal S4 is applied to the input 49 of a branching device 50, the function of which is to produce first and second control pulses SC1, SC2, delivered at the same frequency F as the fourth signal S4 and intended to control the first transistor 4 and the second transistor 5 respectively.

The first and second control pulses SC1, SC2,(not depicted) have a width or duration t which is substantially equal to or smaller than half the time between the leading edges of two pulses of the same type, i.e. half the period P corresponding to the frequency F ($t<\frac{1}{2}F$). Furthermore, the second control pulses SC2 are time-lagged with respect to the first control pulses S1, by a half period P/2 ($P/2=\frac{1}{2}F$) such that the first and second control pulses SC1 and SC2 are respectively applied to the first and second transistor 4, 5, in phase opposition.

The branching device 50 delivers the first control pulses SC1 through a first output 51 which is linked to the cathode of a third diode d3 and to the first end 53 of a resistor R1, the second end 54 of which is linked to the anode of the third diode d3 and to the control input G1 of the first transistor 4. The branching device 50 delivers the second control pulses SC2, through a second output 52, linked to the cathode of a fourth diode d4 and to the first end 55 of a second resistor R2; the second end 56 of the second resistor R2 is linked to the anode of the fourth diode d4 and the control input G2 of the second transistor 5.

The following is the general working of the current-supplying device 1 according to the invention.

When the device is put into operation, actuated for example, from the control panel 40 by means of a link 60 between the control panel and the branching device 50, permit the output of control pulses SC1, SC2. These pulses SC1, SC2 are applied to the first and second transistor 4, 5 respectively, by means of networks formed, on the one hand, by the third diode d3 and the resistor R1, and, on the other hand, by the fourth diode d4 and the second resistor R2. The two transistors 4, 5, are prevented from being simultaneously off by a simple dissymmetry when each transistor 4, 5 is on or off.

The control pulses SC1, SC2 have a frequency F corresponding to an initial operating frequency of the current inverter 2. Since the control pulses SC1, SC2 are, for example, positive, the first pulses SC1 cause the first transistor 4 to become conductive so that, with the exception of the relative drop in voltage at the terminals of the first transistor 4, the positive polarity + of the direct voltage V1 is applied at the junction 6, and the capacitor 19, which was charged at an intermediate voltage V2, tends to be discharged into the load circuit 12–13, i.e. into the inductor 16 and the primary winding 12 which represents the filament 23, the heating current I being then established in the direction represented by the arrow marked $I_{C1}$. The second capacitor 20 itself tends to be charged at the value of the positive polarity + of the direct voltage V1. At the end of the control pulse SC1, the first transistor 4 is off and the leading edge of a second control pulse SC2 makes the second transistor 5 on, and this second transistor 5 applies the negative polarity − of the direct voltage V1 to the junction 6. The phenomenon is then the reverse of the preceding one, i.e. the second capacitor 20 tends to be discharged into the load circuit 12–13, and the first capacitor 19 tends to be charged. The heating current I then has the direction shown by the second arrow $I_{C2}$. This operation is repeated for each control pulse SC1, SC2.

Each of the first and second diode d1, d2, has a dual function:

1. The first and second diodes d1, d2, protect the first and second transistors 4, 5, respectively against excess voltages, i.e. there is a peak-limiting function performed by each diode d1, d2 functioning in reverse.

2. Each diode d1, d2, has the function of directly conducting the reactive current when the opposite transistor 4, 5, is off: the first diode d1 causes the second transistor 5 to go off in order to lead the reactive current to the positive pole + of the voltage V1; the second diode d2 causes the first transistor 4 to go off in order to loop the reactive current back to the negative pole − of the voltage V1. This implies that the diodes d1, d2, are quickly conductive.

The transistors 4, 5, are thus protected efficiently and far more simply than is the case with switching-over means which, in the prior art, have the task of clipping a direct voltage. This is possible primarily because the transistors 4, 5, are of the field-effect type and are quick in switching over.

The regulation circuit, formed by the current sensor 9, the converting device 25, the error signal generator 42 and the voltage/frequency converter 46 regulate the heating current I at the root-mean-square value of this current, corresponding to the set value VC delivered by the control panel 40.

Assuming that the heating current value I is different from the one imposed by the set value VC, there is a resultant non-zero error signal SE.

According to one characteristic of the invention, a non-zero error signal SE applied to the voltage/frequency converter 46, causes a modification of the frequency F of the pulses (signals 4) that this signal applies to the branching device 50, and consequently causes a modification in the frequency of the pulses SC1, SC2, that the branching device 50 applies to the transistors 4, 5, causing a variation in the operating frequency of the current inverter 2 so as to modify the value of the impedance Z presented by the oscillating circuit 13 including the inductor 16 in series with the capacitors 19, 20.

Since the oscillating circuit 13 is in series with the load formed by the resistance R of the filament 23, the value of the heating current I is directly related to the impedance Z of the oscillating circuit LC and decreases or increases depending on whether this impedance decreases or increases.

In the non-exhaustive example described herein, the current inverter 2 works within a relatively high range of frequencies, from 18 KHZ to 35 KHZ for example, providing not only for a substantial reduction in the volume of the elements, especially the magnetic elements and, more especially, the volume of the isolating transformer 30, but also, for a quick response from the regulation circuit as well as a quick shutdown if this is needed for safety reasons.

In the non-exhaustive example of the description, the inductor 16 and the capacitors 19, 20, are chosen such that the resonance frequency Fo of the oscillating circuit 13 is somewhat below the minimum operating frequency of the current inverter 2 (15 KHZ for example) so that in the load circuit 12–13, the current is in advance of the voltage. This arrangement being favorable for the switching over of the transistors 4, 5.

The oscillating circuit 13 comprises the inductor 16 and a series-connected capacitance formed by the capacitors 19 and 20. The capacitors 19 and 20, in addition to forming the capacitance of the oscillating circuit 13, are arranged in series in the direct voltage V1 and thus provide for effective decoupling of the load circuit 12–13 at the capacitive point 18. These two capacitors 19, 20 must be considered to be parallel-mounted to form the capacitance of the oscillating circuit 13.

In one mode of embodiment, given as a non-exhaustive example:

The inductor 16 has a value of 325 microhenries;

The capacitors 19, 20, each have a value of 0.1 microfarads and form a capacitance of 0.2 microfarad;

The resonance frequency $F_o$ of the oscillating circuit 13 is substantially equal to 15 KHZ;

The leakage inductance of the transformer 30 is about 250 microhenries;

The direct voltage V1 has a value of 200 volts.

Figure 2:
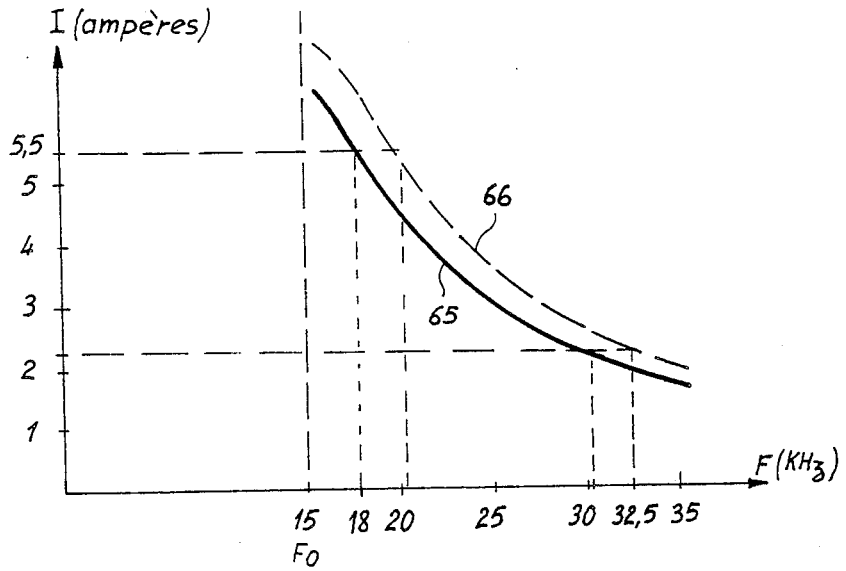
FIG. 2 is a graph which illustrates the working of the current-supplying device according to the invention.

Thus, the current-supplying device I according to the invention can be used to successively supply current to several filaments 23, 24 having different resistance values as illustrated in FIG. 2.

.FIG. 2 is a graph which depicts, in a first and second curve 65, 66, the variations of the heating current I as a function of the frequency F, the frequency F being shown on the x-axis and expressed in KHZ, and the heating current I being shown on the y-axis and expressed in amperes.

As mentioned earlier, the resonance frequency $F_o$ of the oscillating circuit 13 is 15 KHZ and the range of frequencies F of operation is from 18 to 35 KHZ.

In the non-exhaustive example described herein, the first and second curve 65, 66, respectively correspond to the supplying of current to a first and second filament 23, 24, the first filament 23 having a resistance of 4.5 ohms and the second filament 24 having a resistance of 1 ohm.

These first and second curves 65, 66, illustrate the possible values of the current I in the range of frequencies from 18 to 35 KHZ. It is observed that the same values of the current I are obtained with different frequencies F depending on whether the filament to be supplied with current is a filament 23 of 4.5 ohms (first curve 65) or a filament 24 of 1 ohm (second curve 66):

For 4.5 ohms, the values of 5.5 amperes and 2.2 amperes are obtained at 18 KHZ and 30.5 KHZ respectively;

For 1 ohm, the values of 5.5 amperes and 2.2 amperes are obtained at 20.5 KHZ and 32.5 KHZ respectively.

In order to avoid accidental overloading, a limit is placed on the maximum value of the heating current by means of a frequency-limiting device (not depicted) which is, itself, of a conventional type. The frequency-limiting device is used, when approaching the resonance frequency $F_o$, to limit the operating frequency range to a value higher than $F_o$. This limit being placed at about 15.7 KHZ in the non-exhaustive example described herein.

This description is a non-exhaustive example, showing that the working principle of the current-supplying device 1 according to the invention can be used not only to supply an X-ray tube filament with a heating current regulated at high precision, but also to automatically supply heating current successively to several filaments with different resistance values within a wide range of power values while, at the same time, maintaining high precision in the definition of the heating current.

Obviously, numerous modifications and variations of the present invention are possible in light of the above teachings. It is therefore to be understood that within the scope of the appended claims, the invention may be practiced otherwise than as specifically described herein.

What is claimed is:

1. A device for supplying current to a filament of at least one X-ray tube, said device comprising:

a generator means for providing control pulses;

a current inverter for receiving said controlled pulses and outputting an alternating heating current from a direct voltage, a regulator circuit for regulating said heating current according to a set value;

a load circuit for receiving said alternating heating current wherein said load circuit comprises an oscillating circuit and a primary winding of a transformer wherein said heating current is applied through said transformer to said filament of said at least one X-ray tube and wherein said heating current has the same frequency as the frequency of said control pulses;

wherein said oscillating circuit is connected in series with said primary winding;

wherein said regulator circuit includes a means for outputting an error signal which is applied to said generator in order to modify the frequency of said control pulses to thereby modify the impedance of said oscillating circuit until the value of said heating current corresponds to said set value.

2. A device for supplying current to a filament of at least one X-ray tube, said device comprising:

a generator means for providing control pulses;

a current inverter for receiving said controlled pulses and outputting an alternating heating current from a direct voltage comprising between the direct voltage poles, firstly, at least two electronic switches in series and, secondly, two capacitors in series, a first end of the load circuit being linked to junction of the two electronic switches, the other end of the load circuit being linked to a junction of the two capacitors;

a regulator circuit for regulating said heating current according to a set value;

a load circuit for receiving said alternating heating current wherein said load circuit comprises a primary winding of a transformer wherein said heating current is applied through said transformer to said filament of said at least one X-ray tube and wherein said heating current has the same frequency as the frequency of said control pulses;

an oscillating circuit means connected to said load circuit;

wherein said regulator circuit includes a means for outputting an error signal which is applied to said generator in order to modify the frequency of said control pulses to thereby modify the impedance of said oscillating circuit means until the value of said heating current corresponds to said set value.

3. Current-supplying device according to the claim 2, wherein the regulation circuit means comprises a current sensor connected to said load circuit.

4. Current-supplying device according to the claim 2, wherein the two capacitors constitute the capacitance of the oscillating circuit means.

5. Current-supplying device according to the claim 2, wherein the two electronic switches are field-effect transistors.

6. Current-supplying device according to the claim 2, wherein the oscillating circuit means comprises a capacitance in series with an inductive resistor.

7. Current-supplying device according to the claim 2, wherein the oscillating circuit means has a resonance frequency below a frequency F of the control pulses.

8. Current-supplying device according to the claim 2, wherein the two capacitors form a decoupling of the load circuit.

9. Current-supplying device according to any one of claims 3-14 8 and 1, comprising a switching-over device used to select an X-ray tube, the filament of which is to be supplied with heating current.

* * * * *